US005660006A

United States Patent [19]

Emerson, Jr.

[11] Patent Number: 5,660,006

[45] Date of Patent: Aug. 26, 1997

[54] WALL SUPPORT DEVICE

[76] Inventor: Tim R. Emerson, Jr., R.R. 1, Box 1036, Taylorville, Ill. 62568

[21] Appl. No.: 620,899

[22] Filed: Mar. 25, 1996

[51] Int. Cl.[6] ..... E04G 21/26

[52] U.S. Cl. ..... 52/127.2; 52/127.5; 52/146; 52/149; 52/749.14; 52/749.13; 52/DIG. 1; 52/712; 52/713

[58] Field of Search ..... 52/127.5, 127.2, 52/749.13, 749.14, DIG. 1, 146, 713, 712, 703, 698, 151, 149, 155; 248/357, 213–217

[56] References Cited

U.S. PATENT DOCUMENTS

| | | | |
|---|---|---|---|
| 2,641,846 | 6/1953 | Zeng | 52/749.13 X |
| 3,874,625 | 4/1975 | Housen et al. | 52/749.13 X |
| 4,098,037 | 7/1978 | Doy | 52/149 X |
| 5,357,721 | 10/1994 | Alvarez | 52/713 X |

*Primary Examiner*—Carl D. Friedman
*Assistant Examiner*—W. Glenn Edwards
*Attorney, Agent, or Firm*—Brinks Hofer Gilson & Lione

[57] ABSTRACT

A bracing apparatus for use with a partially or fully built wall. The wall extends upward from a base surface and has a top surface, a first face and a second face. The wall is constructed from a plurality of stacked masonry forms. The bracing apparatus includes first and second support members, a lock and a base securing mechanism. The first support member rests on the top surface of the wall and has a first brace extending downward adjacent the first face. The second support member is movably connected to the first support member and has a second brace extending downward adjacent the second face. The lock is connected to the first and second support members and is capable of securing the first and second support members in a position substantially equal to the width of at least one of the masonry forms. The ground securing mechanism is connected to at least one of the first and second support members and the base surface.

20 Claims, 1 Drawing Sheet

WALL SUPPORT DEVICE

BACKGROUND OF THE INVENTION

The present invention relates to a wall support system. In particular, the present invention relates to the field of wall support devices that hold a wall erect during construction.

When building a masonry or other similar wall, the section of wall which has been erected remains free-standing until the entire wall is finished and until the roof framework or upper story framework has been constructed so as to permanently support the wall. During this point in the construction, if a wall is improperly supported, the wall may fall down if subject to external forces such as a strong wind resulting from a storm, etc. In addition to the significant expense entailed in rebuilding the wall, workers at the construction site may be injured by the falling wall.

Wall support braces have been previously developed for various purposes. For example, U.S. Pat. No. 5,343,667 issued to Peden, on Sep. 6, 1994, discloses a form brace for use during the construction of a concrete wall. The brace includes a spacer that holds two form boards against the recently poured concrete. Two struts extend downward from the spacer toward the ground in order to support the spacer. Each strut is formed from two telescoping portions so that the relative length of the struts can be adjusted.

Another example of a wall support assembly is shown in U.S. Pat. No. 4,079,556 issued to Luck et al. on Mar. 21, 1978. The assembly includes a plurality of plates that are inserted between various courses of a masonry wall. Anchor assemblies are secured to the ends of the plates and the ground.

While various support devices have been developed for use with specific types of walls, few developments appear to have been made in providing a universal support device useful with masonry forms of varying widths. Obviously, a more efficient wall support device is needed.

SUMMARY OF THE INVENTION

The present invention provides a bracing apparatus for use with a partially or fully built wall. The wall is constructed from a plurality of stacked masonry forms. The wall extends upward from the ground or a base surface and has a top surface, a first face and a second face. The bracing apparatus includes first and second support members, a lock and a base securing mechanism. The first support member rests on the top surface of the wall and has a first brace extending downward adjacent the first face. The second support member is movably connected to the first support member and has a second brace extending downward adjacent the second face. The lock is connected to the first and second support members and secures the first and second support members in a position substantially equal to the width of at least one of the masonry forms. The ground securing mechanism is connected to at least one of the first and second support members and the ground or a base surface.

The present invention will be best understood with reference to the detailed description below read in conjunction with the accompanying drawings.

DETAILED DESCRIPTION OF THE PREFERRED EMBODIMENTS

Figure 1:
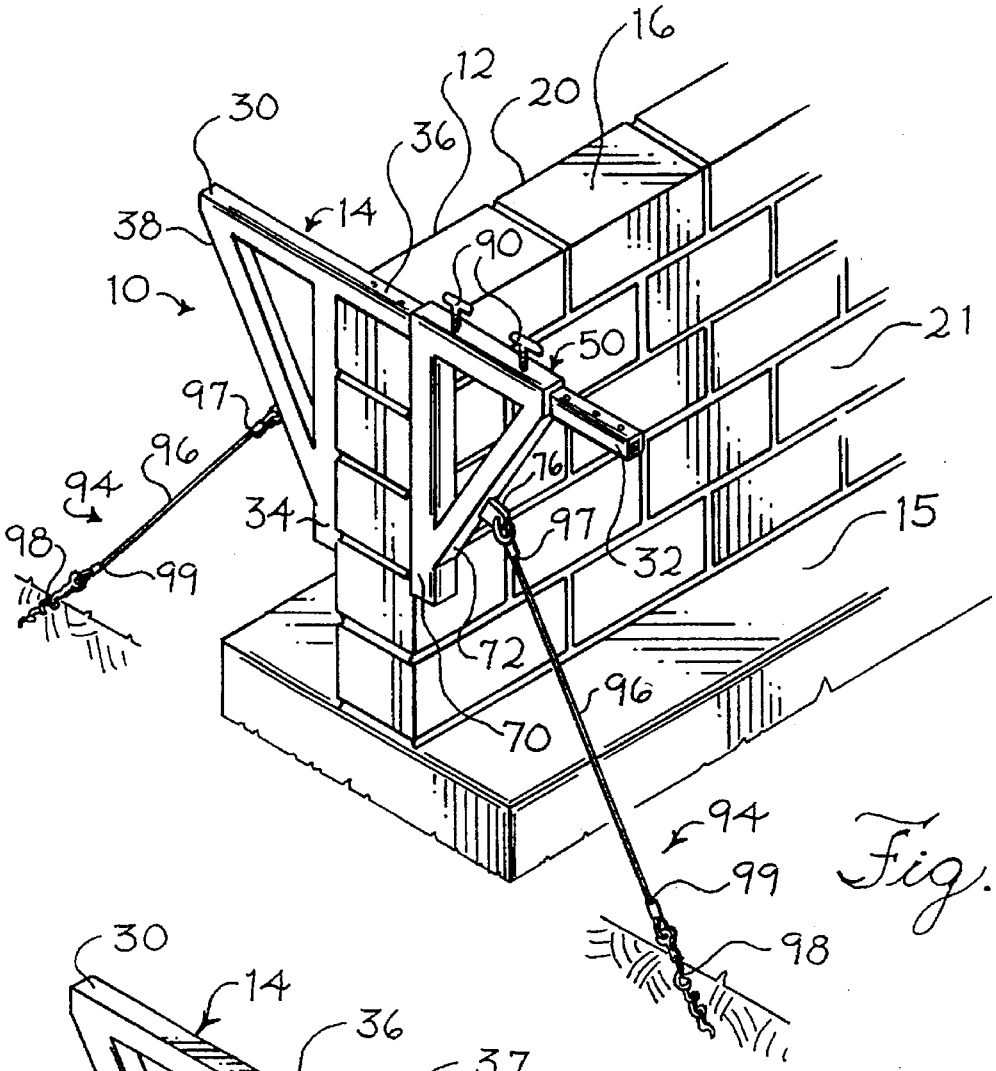
FIG. 1 is a perspective view of a preferred embodiment of the present invention.
Figure 2:
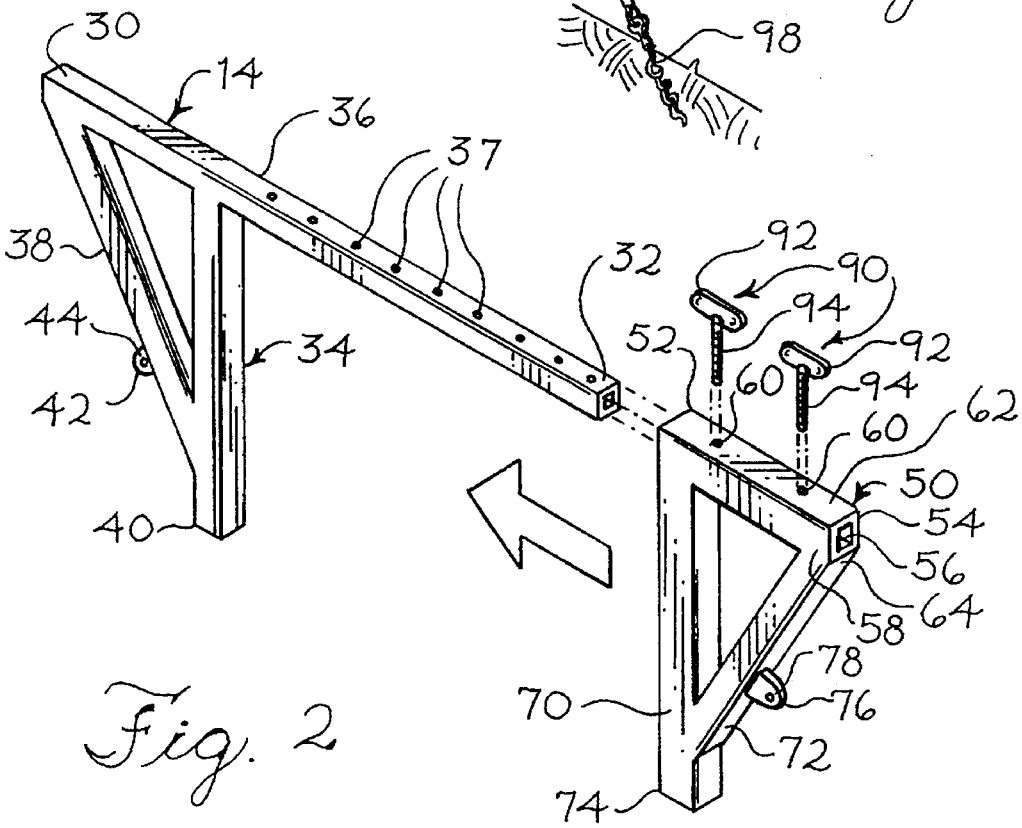
FIG. 2 is an exploded view of the support member shown in FIG. 1.

Referring to the drawings, FIG. 1 shows a preferred embodiment of the wall support system 10 of the present invention including the partially built wall 12 and support member 14. The wall 12 extends upward from a base surface 15. The base surface may be the ground or a man-made base. As used herein, the term "base surface" refers to either the ground or a man-made base. The wall 12 includes a top surface 16, a first face 18, and a second face 20. As shown in FIG. 1, the wall 12 is made from a plurality of masonry blocks 21 laid upon one another with mortar therebetween. It should be appreciated that the support member 14 can be used to support many different types of masonry such as cinder blocks or bricks. In addition, it is an important aspect of the present invention that the support brace 14 be capable of use with masonry forms having a wide variety of widths such as 4", 6", 8", 10" and 12".

In the embodiment illustrated, the support member 14 has a first end 30 and a second end 32. A first brace 34 extends downward from the support member 14 a short distance from the center 36. A plurality of threaded apertures 37 are formed on the support member 14 approximately between the center 36 and the second end 32. The support member 14 further includes a first angled brace 38 that extends between the first end 30 of the support member 14 and the base 40 of the first brace 34. An attachment member 42 is centrally located on the first angled brace 38. The attachment member 42 extends outward from the first angled brace 38 in the form of a tab. An aperture 44 is located therein.

The second support member or mating member 50 also has a first end 52 and a second end 54. A rectangular and horizontally extending passageway 56 extends through the upper portion 58 of the mating member 50. In addition, threaded apertures 60 are located on the top and bottom surfaces 62, 64 of the upper portion 58 of the mating member 50 (only the apertures on the top surface 62 are shown). In a manner similar to the support member 14, a second brace 70 extends downward from the mating member 50. However, the second brace 70 extends downward from the first end 52 of the mating member 50. A second angled brace 72 extends between the second end 54 of the mating member 50 and the base 74 of the second brace 70. A second attachment member 76 is centrally located on the second angled brace 72. The second attachment member 76 extends outward from the second angled support member 72 in the form of a tab. An aperture 78 is located therein. Locking elements 90 include a grip portion 92 and a downwardly extending threaded rod 94. The threaded rod 94 is sized to be received within the threaded apertures 60 and 37.

As shown in FIG. 1, a ground securing mechanism 94 is connected to the attachment members 42 and 76. More specifically, in the illustrated embodiment, the ground securing mechanism comprises wires 96 having upper ends 97 that are secured to the attachment members 42 and 46 through their respective apertures 44 and 78. Ground engagement elements 98 are attached to the lower ends 99 of the wires 96. The ground engagement elements 98 have a corkscrew shape and are secured to the base surface 15. It should be recognized, however, that a wide variety of ground securing mechanisms such as telescoping poles and ground securing pins could also be used to anchor the support member 14.

The system 10 is assembled as shown in FIG. 1. The center 36 of the support member 14 is positioned approximately at the center of the top surface 16 of the wall 12. The first brace 34 extends downward adjacent the second face 20 in order to thereby support the wall 12. The mating member 50 is then slid into engagement with the support member 14 so that the second brace extends downward adjacent the first face 18 of the wall 12. More specifically, the passageway 56 receives a portion of the support member between the center 36 and the second end 32.

Once the support member 14 and the mating member 50 are engaged so that the first and second braces 34, 70 are positioned adjacent the first face and the second face 18, 20, a user locks these elements into a fixed position. In the illustrated embodiment, the lock comprises the locking elements 90 and threaded apertures 60. In particular, a user grabs the grip portion 92 and rotates the threaded rod 94 into the threaded apertures 60, 37. In this manner, the mating member 50 is locked into a selected position relative to the support member 14. It will be appreciated that other suitable lock or locking mechanisms can also be used.

After the support member 14 and the mating member 50 are locked together, these elements are secured to the base surface 15 through at least one of the illustrated or described ground securing mechanisms 94. In a preferred embodiment, a ground securing mechanism 94 is provided on each side of the wall 12. In other words, the ground engagement elements 98 are twisted into the base surface 15 in order to thereby secure the system 10 against lateral forces.

In order to disassemble the system 10, a user removes the ground engagement elements 98 from connection with the base surface 15 and disengages the locking elements 90. The mating member 50 and support member 14 can then be disengaged and construction of the wall 12 continued. If necessary, in the future, the system could be reassembled as described above.

In the preferred embodiment, the support member 14 and the mating element 50 are made from rectangular-shaped 12 ga. steel tubing. However, these elements and the other elements of the present invention could be easily constructed from a wide variety of materials with varying shapes known to those of ordinary skill in the art.

The embodiment described is illustrative and not restrictive. The scope of the invention is indicated by the claims rather than by the foregoing description. The invention may be embodied in other specific forms without departing from the spirit of the invention. For example, the locking mechanism or the ground securing mechanism could be easily modified without departing from the spirit of this invention. Similarly, the specific materials used or the configurations of the parts may be easily changed. Accordingly, all changes which come within the scope of the claims are intended to be embraced therein.

I claim:

1. A bracing apparatus for use with a wall constructed from a plurality of vertically stacked masonry forms and extending upward from a base surface, said wall having a top surface, a first face and a second face, said bracing apparatus comprising:

a first support member adapted to rest on said top surface of said wall, said first support member having a first brace extending downward adjacent said first face of said wall;

a second support member movably connected relative to said first support member, said second support member capable of being selectively positioned along a length of said first support member and having a second brace extending downward adjacent said second face of said wall;

a lock connected to said first and second support members, said lock adjustably securing said first and second support members in a position substantially equal to the width of at least one of said masonry forms; and a base securing mechanism connected to at least one of said first and second support members, and said base surface;

whereby said bracing apparatus is adjustable relative to the distance between said first face and second face of said wall and is capable of supporting said wall during construction thereof.

2. The bracing apparatus of claim 1 wherein said first and second support members further include first and second angled braces extending downward from said first and second support members to said first and second braces, respectively.

3. The bracing apparatus of claim 2 wherein said angled braces further include an attachment member for connecting said base securing mechanism thereto.

4. The bracing apparatus of claim 3 wherein said attachment member comprises an outwardly extending tab having an aperture therethrough.

5. The bracing apparatus of claim 4 wherein said base securing mechanism comprises a metal wire.

6. The bracing apparatus of claim 5 wherein said base securing mechanism further includes a corkscrew shaped metal element.

7. The bracing apparatus of claims 1 or 6 wherein said lock comprises a locking bolt that extends through a first aperture in said first and second support members.

8. The bracing apparatus of claim 7 wherein said locking mechanism further includes a second locking bolt that extends through second apertures in said first and second support members.

9. The bracing apparatus of claim 8 wherein said first and second support members are formed from rectangular shaped tubing.

10. The wall support apparatus of claim 9 wherein said first and second support members are made from 12 ga. steel tubing.

11. A wall support system comprising:

a wall extending upward from a base surface, said wall having a top surface, a first face and a second face;

a bracing system comprising:

a support member adapted to rest on said top surface of said wall, said support member having a first end and a second end, and a first bracing member extending downward adjacent said first face of said wall;

a mating member connected to said support member, said mating member capable of being selectively positioned along a length of said support member and having a second bracing member extending downward adjacent said second face of said wall;

a lock connected to said support member and said mating member, said locking mechanism capable of securing said mating member in one of a plurality of selected positions along said support member;

a base securing mechanism connected to said support member and said mating member, and said base surface;

whereby said bracing system is adjustable relative to the distance between said first face and second face of said wall and is capable of supporting said wall during construction.

12. The wall support system of claim 11 wherein said support member and said mating member further comprise first and second angled support members extending downward from said support member and said mating member to said first and second support members, respectively.

13. The wall support system of claim 12 wherein said angled support members further include an attachment member located thereon for connecting said base securing mechanism thereto.

14. The wall support system of claim 13 Wherein said attachment member comprises an outwardly extending tab having an aperture therethrough.

15. The wall support system of claim 11 or 14 wherein said base securing mechanism comprises a metal wire.

16. The wall support system of claim 15 wherein said base securing mechanism further comprises a corkscrew shaped metal element for insertion into the base surface.

17. The wall support system of claim 16 wherein said lock comprises a locking bolt that extends through a first aperture in said support member and a first aperture in said mating member, said apertures extending coaxially.

18. The wall support system of claim 17 wherein said locking mechanism further comprises a second locking bolt that extends through second apertures in said support member and said mating member, said second apertures extending coaxially.

19. The wall support system of claim 18 wherein said support member and said mating member are made from 12 ga. steel tubing.

20. The wall support system of claim 19 wherein said support member and said mating member are formed from rectangular tubing.

* * * * *